US008307798B2

(12) United States Patent
Emmersberger

(10) Patent No.: US 8,307,798 B2
(45) Date of Patent: Nov. 13, 2012

(54) INTERNAL COMBUSTION ENGINE WITH A CRANKSHAFT AND AT LEAST ONE CYLINDER HEAD AS WELL AS A MOTOR VEHICLE WITH SUCH AN INTERNAL COMBUSTION ENGINE

(75) Inventor: Georg Emmersberger, Pfaffing (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 181 days.

(21) Appl. No.: 12/614,875

(22) Filed: Nov. 9, 2009

(65) Prior Publication Data

US 2010/0050968 A1 Mar. 4, 2010

Related U.S. Application Data

(63) Continuation of application No. PCT/EP2008/004646, filed on Jun. 11, 2008.

(30) Foreign Application Priority Data

Jul. 11, 2007 (DE) ..... 10 2007 032 638

(51) Int. Cl.
*F01L 1/26* (2006.01)

(52) U.S. Cl. ..... 123/90.23; 123/90.31; 123/193.5

(58) Field of Classification Search ..... 123/90.16, 123/90.23, 90.22, 90.31, 193.5
See application file for complete search history.

(56) References Cited

U.S. PATENT DOCUMENTS

| | | | | |
|---|---|---|---|---|
| 4,592,314 | A | 6/1986 | Tsuchida | |
| 4,635,592 | A | 1/1987 | Weichsler | |
| 4,686,945 | A | 8/1987 | Inagaki et al. | |
| 4,949,687 | A | 8/1990 | Emmersberger | |
| 6,394,053 | B2 * | 5/2002 | Shin | 123/90.45 |

FOREIGN PATENT DOCUMENTS

| | | | |
|---|---|---|---|
| DE | 66 017 58 | | 4/1969 |
| DE | 27 03 520 | A1 | 8/1978 |
| DE | 38 41 710 | A1 | 7/1989 |
| DE | 40 16 226 | A1 | 11/1991 |
| DE | 100 65 490 | A1 | 8/2001 |
| DE | 20 2007 003 411 | U1 | 6/2007 |
| EP | 1 270 878 | A2 | 1/2003 |
| GB | 1177861 | | 1/1970 |

OTHER PUBLICATIONS

German Search Report dated Apr. 16, 2008 including partial English translation (Nine (9) pages).
International Search Report dated Oct. 6, 2008 including English translation (Six (6) pages).

* cited by examiner

*Primary Examiner* — Ching Chang
(74) *Attorney, Agent, or Firm* — Crowell & Moring LLP

(57) ABSTRACT

An internal combustion engine includes a crankshaft as well as at least one cylinder head, which can be traversed by flow at least approximately in the crankshaft axial direction from an inlet duct to an outlet duct and which has valves for opening and closing the ducts. Two camshafts actuate the valves, and each of the camshafts is assigned an inlet valve and an outlet valve. The two camshafts are arranged at least approximately parallel to the crankshaft. A motor vehicle, in particular a motorcycle, can be provided with such an internal combustion engine.

8 Claims, 4 Drawing Sheets

INTERNAL COMBUSTION ENGINE WITH A CRANKSHAFT AND AT LEAST ONE CYLINDER HEAD AS WELL AS A MOTOR VEHICLE WITH SUCH AN INTERNAL COMBUSTION ENGINE

CROSS-REFERENCE TO RELATED APPLICATIONS

This application is a continuation of PCT International Application No. PCT/EP2008/004646, filed Jun. 11, 2008, which claims priority under 35 U.S.C. §119 to German Patent Application No. DE 10 2007 032 638.8, filed Jul. 11, 2007, the entire disclosures of which are herein expressly incorporated by reference.

BACKGROUND AND SUMMARY OF THE INVENTION

The invention relates to an internal combustion engine having a crankshaft and as at least one cylinder head, which can be traversed by flow at least approximately in the crankshaft axial direction from an inlet duct to an outlet duct and which has valves for opening and closing the ducts.

An internal combustion engine of this type is known, for example, from DE 38 41 710 A1, where, as a consequence of actuating the valves, there is a single camshaft with an inlet cam and an outlet cam. Starting from the cams, the valves are actuated by way of rocker arm shafts, which lie parallel to the valve planes, in that one cam actuates simultaneously two (inlet and/or outlet) valves by way of a rocker arm shaft. In so doing, the cams engage with one end of the rocker arm shaft, and the arms for actuating the valves are arranged along the rocker arm shaft so as to be spaced apart from the cam engagement arm in the rocker arm shaft axial direction. Although this design makes possible a relatively small installation space for a valve controller for controlling a plurality of identical valves, which valves are disposed in the cylinder head, only a limited rotational speed can be reached especially in the case of high valve acceleration.

The invention is based on the task of providing an internal combustion engine of the above-described type. In this context, a valve controller for controlling a plurality of valves that are disposed in a cylinder head requires only a small amount of installation space. At the same time, the internal combustion engine offers an especially direct and rigid transmission path, so that especially in the case of high valve acceleration, high rotational speeds can be reached. In addition, a motor vehicle shall be provided with an internal combustion engine of this type.

This object of the invention is achieved with an internal combustion engine including a crankshaft and at least one cylinder head, which cylinder head can be traversed by flow at least approximately in the crankshaft axial direction from an inlet duct to an outlet duct and which has valves for opening and closing the ducts. A first camshaft and a second camshaft are provided for actuating the valves. Both the first camshaft and the second camshaft are assigned an inlet valve and an outlet valve and are arranged at least approximately parallel to the crankshaft.

In addition, the object of the invention is achieved with a motor vehicle, including an internal combustion engine of this type.

Advantageously, this configuration makes possible an especially compact and space saving design. Only a few components are required so that the cost of production, assembly and maintenance are reduced, and a direct and rigid transmission path is achieved when the valve is actuated.

Especially preferred embodiments and further developments are described herein.

Preferably, the valves are actuated directly by use of cam followers. A direct actuation of the valves by use of bucket tappets is also preferred.

It is very advantageous for the inlet and outlet valve(s) to slope outwards with their cam sided ends in relation to a central plane, sharing the cylinder in the direction of flow. Then, the cylinder head can be configured as a radial head, so that, in particular, design space advantages are achieved. For example, in this way it is possible to gain design space for housing an ignition coil.

According to a preferred further development of the invention, the first camshaft and the second camshaft, as well as the bucket tappets, are disposed in a structurally separate carrier, so that the valve gear is structurally separated from the valves. Thus, it is possible to simplify not only the manufacture (due to being separate) of the cylinder head and the controller carrier with a valve gear, but it is also possible to simplify the assembly, because the valve gear can be pre-assembled separately. It is practical to dispose the first and the second camshaft as well as the cam follower with the cam follower shaft(s) in a structurally separate carrier.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
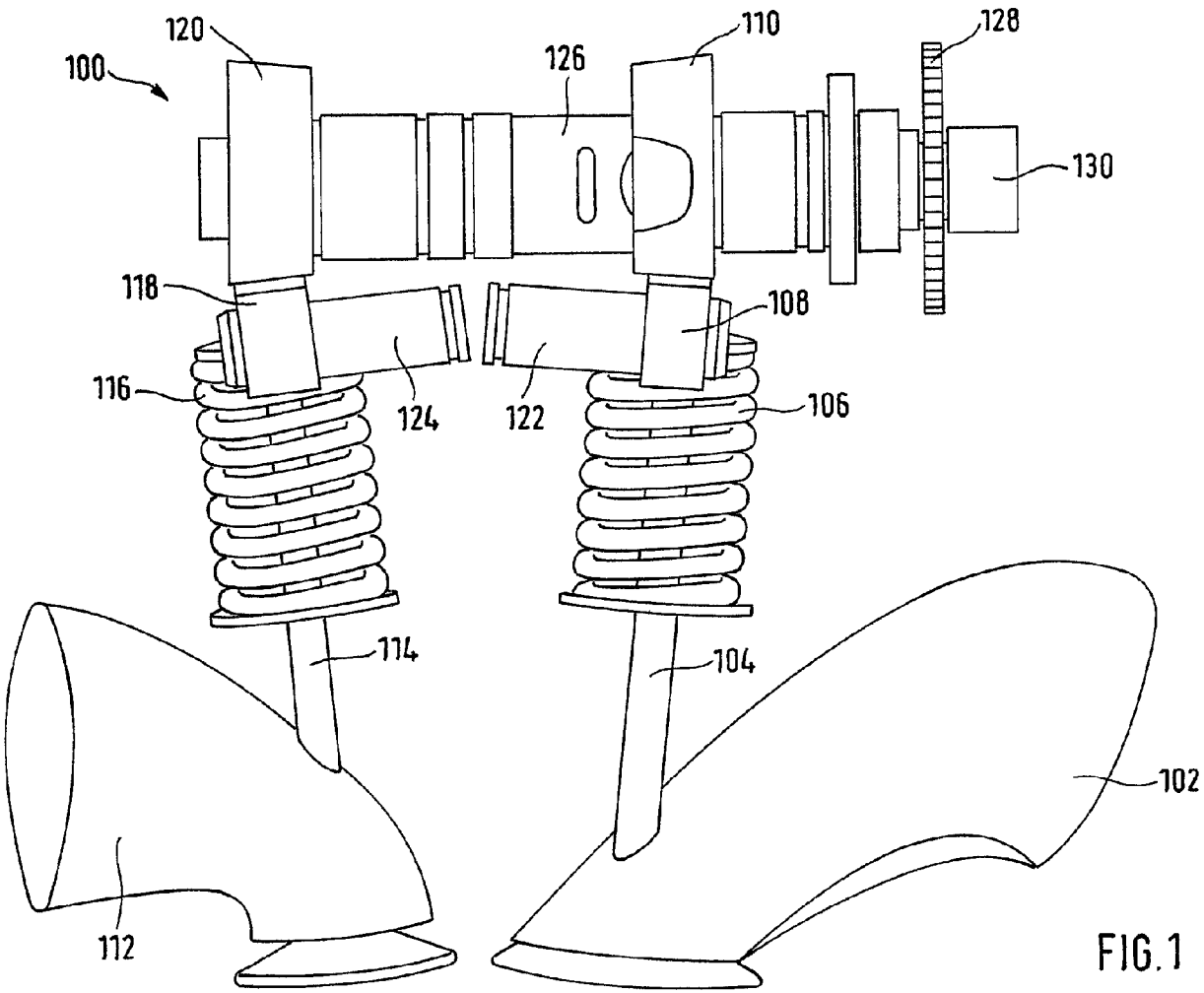
FIG. 1 is a schematic drawing of a side view of an exemplary cylinder head, which can be traversed by flow in the crankshaft axial direction from an inlet duct to an outlet duct and which has two camshafts arranged parallel to the crankshaft.
Figure 2:
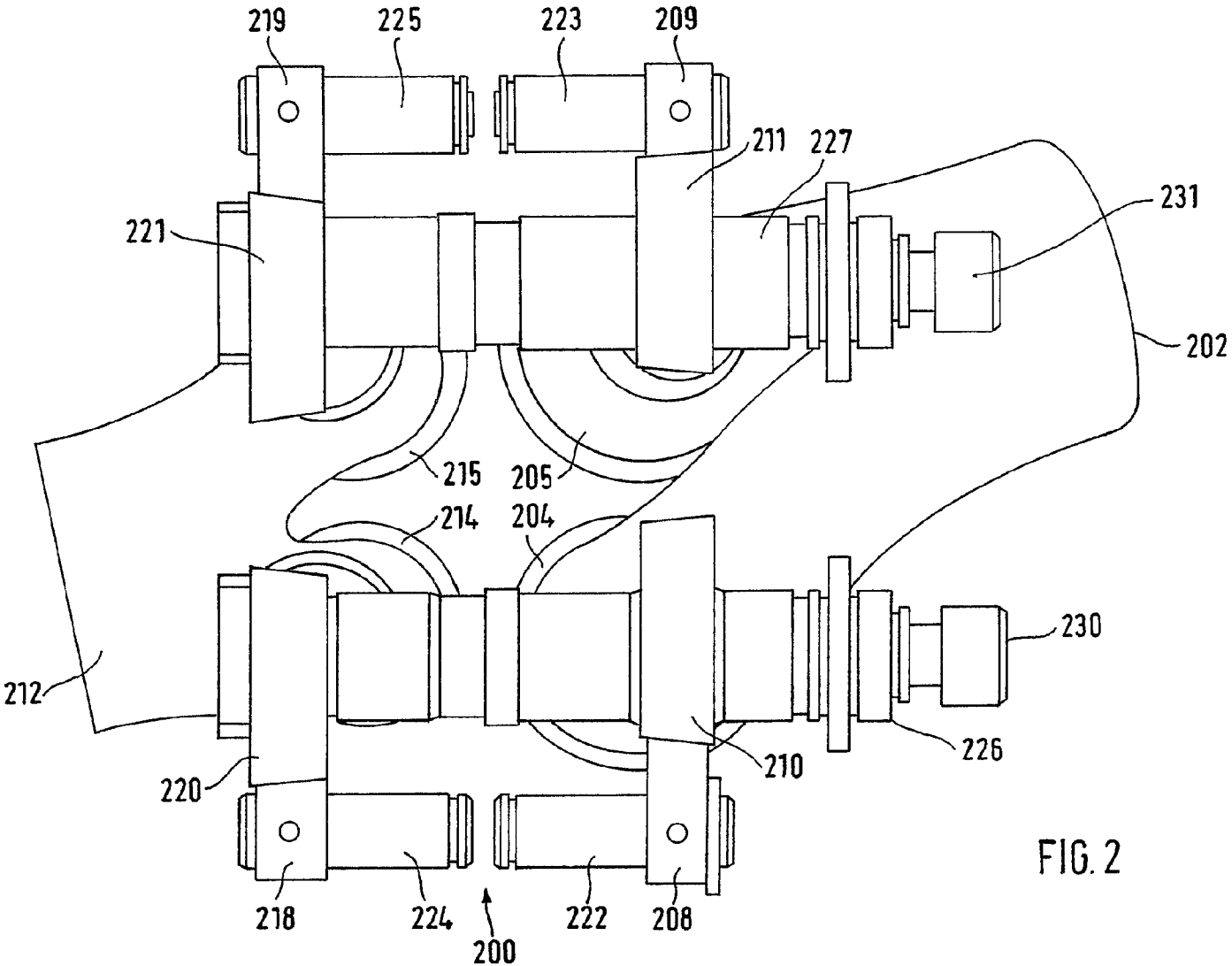
FIG. 2 is a schematic drawing of a top view of the cylinder head of FIG. 1.
Figure 3:
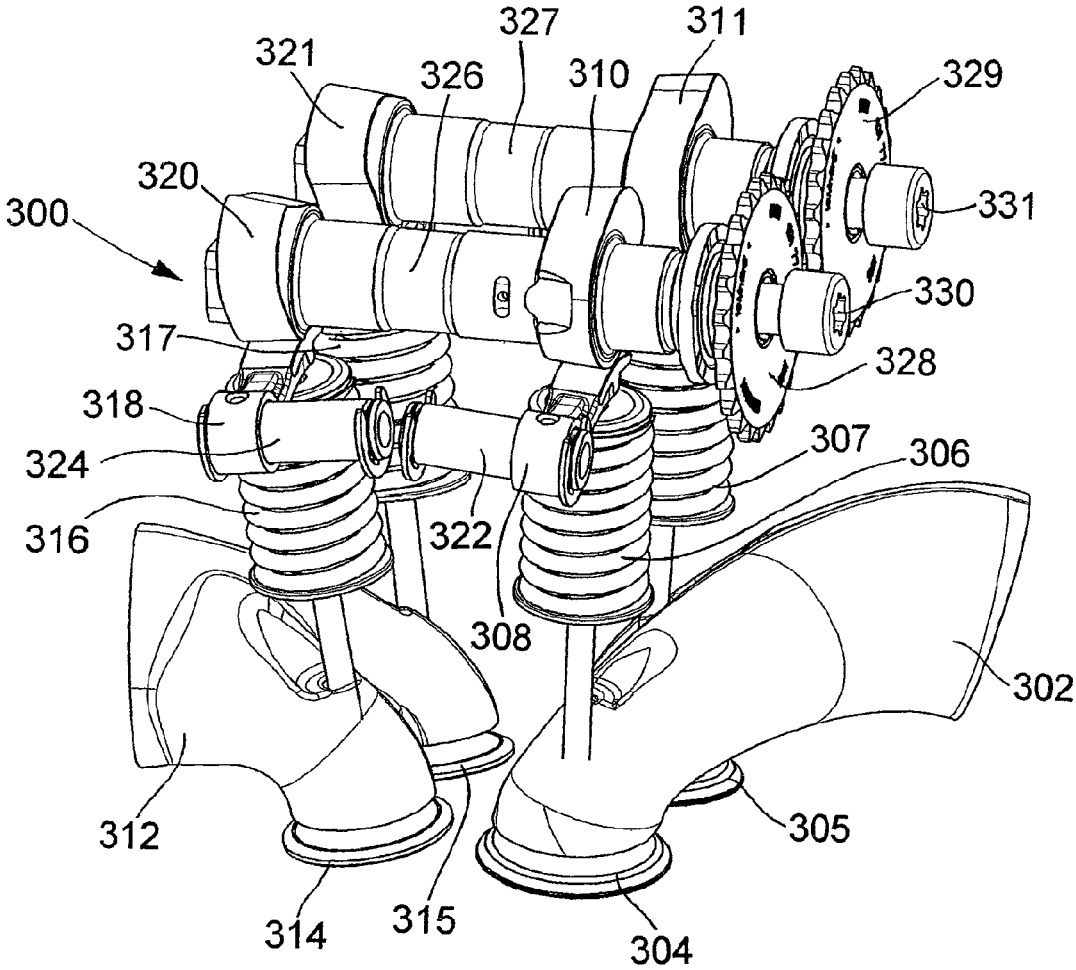
FIG. 3 is a schematic drawing of an isometric view of a cylinder head, which can be traversed by flow in the crankshaft axial direction from an inlet duct to an outlet duct and which has two camshafts arranged parallel to the crankshaft.
Figure 4:
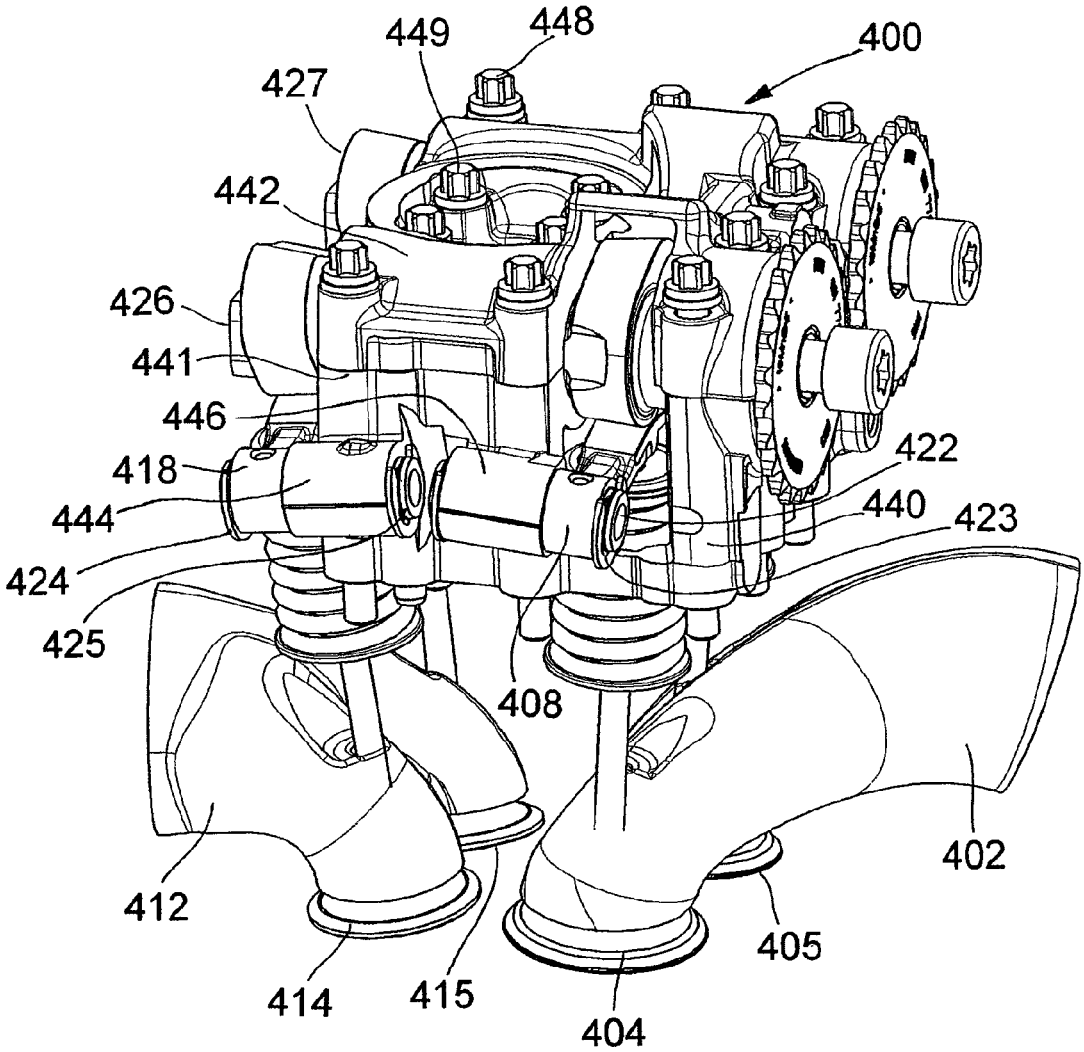
FIG. 4 is a schematic drawing of the cylinder head with a valve controller carrier.

FIGS. 1 through 4 show a selection of parts: a cylinder head 100, 200, 300, which can be traversed by flow in the crankshaft axial direction from an inlet duct 102, 202, 302, 402 to an outlet duct 112, 212, 312, 412. The cylinder head has two camshafts 126, 226, 227, 326, 327, 426, 427, which run parallel to the crankshaft. FIG. 4 shows the same cylinder head with a valve controller carrier 400. In this context FIG. 1 is a side view, FIG. 2 is a top view, and FIGS. 3 and 4 are isometric views.

The cylinder head 100, 200, 300 is a component of a two cylinder internal combustion engine, which is not illustrated in detail at this point. The internal combustion engine in boxer configuration is preferably used for driving a motorcycle. The internal combustion engine is arranged in the vehicle so as to be aligned with its crankshaft in the longitudinal direction of the vehicle. Each cylinder head 100, 200, 300 can be traversed by flow at least approximately in the crankshaft axial direction from an inlet duct 102, 202, 302, 402, which is aimed in the direction of the rear end of the vehicle, to an outlet duct 112, 212, 312, 412, which is aimed in the direction of the front end of the vehicle. In the figures, each inlet duct 102, 202, 302, 402 and each outlet duct 112, 212, 312, 412 is shown by the volume, jacketed by the duct wall.

In order to open and close the ducts 102, 202, 302, 402, 112, 212, 312, 412, the inlet side and the outlet side exhibit in each case two valves 104, 114, 204, 205, 214, 215, 304, 305, 314, 315, 404, 405, 414, 415, which are spring loaded by the valve springs 106, 116, 306, 307, 316, 317 in the closing direction. The valves are actuated by camshafts 126, 226, 227, 326, 327, 426, 427, which are driven by the crankshaft. To this end, the camshafts 126, 226, 227, 326, 327, 426, 427 exhibit in each case a drive wheel 128, 328, 329, which can be driven by way of a traction mechanism, starting from the crankshaft. As an alternative, it is also possible to drive only one camshaft 126, 226, 227, 326, 327, 426, 427, starting from the crankshaft. Moreover, the camshafts 126, 226, 227, 326, 327, 426, 427 can be connected together in a drive relationship. Optionally, the drive of one of the two camshafts 126, 226, 227, 326, 327, 426, 427 can be switched, so that the corresponding valves 104, 114, 204, 205, 214, 215, 304, 305, 314, 315, 404, 405, 414, 415 remain unactuated even in the event that the internal combustion engine is running.

The camshafts 126, 226, 227, 326, 327, 426, 427 are provided in each case with two cams 110, 120, 210, 220, 310, 320 and 211, 221, 311, 321, so that an inlet valve 104, 204, 205, 304, 305, 404, 405 and an outlet valve 114, 214, 215, 314, 315, 414, 415 can be actuated in each case with a camshaft 126, 226, 227, 326, 327, 426, 427.

The force/motion is transferred from the cams 110, 120, 210, 211, 220, 221, 310, 311, 320, 321 to the valves 104, 114, 204, 205, 214, 215, 304, 305, 314, 315, 404, 405, 414, 415 by the short path directly over the cam followers 108, 118, 208, 209, 218, 219, 308, 318, 408, 418, which are mounted so as to swivel on the cam follower shafts 122, 124, 222, 223, 224, 225, 322, 324, 422, 424. As an alternative, instead of the cam followers 108, 118, 208, 209, 218, 219, 308, 318, 408, 418, there can also be bucket tappets with or without a valve clearance compensation device, between the cams 110, 120, 210, 211, 220, 221, 310, 311, 320, 321 and the valves 104, 114, 204, 205, 214, 215, 304, 305, 314, 315, 404, 405, 414, 415.

The inlet and outlet valves 104, 114, 204, 205, 214, 215, 304, 305, 314, 315, 404, 405, 414, 415 are outwardly sloped with their cam sided ends in relation to a central plane, sharing the cylinder in the direction of flow, so that the cylinder head 100, 200, 300 can be depicted as a radial cylinder head. Correspondingly, the cam followers 108, 118, 208, 209, 218, 219, 308, 318, 408, 418 with their cam follower shafts 122, 124, 222, 223, 224, 225, 322, 324, 422, 424 are arranged so as to be slanted (FIG. 1), and the cams 110, 120, 210, 211, 220, 221, 310, 311, 320, 321 exhibit inclined cam surfaces.

The valve control gear, including the camshafts 126, 226, 227, 326, 327, 426, 427 as well as the cam followers 108, 118, 208, 209, 218, 219, 308, 318 with their cam follower shafts 122, 124, 222, 223, 224, 225, 322, 324, 422, 424, is mounted in a structurally separate valve control carrier 400. The valve control carrier 400 is split into two parts along a separating plane 441 and includes a lower half 440 and an upper half 442. The separating plane 441 runs in the camshaft plane at least approximately in the area of the camshaft axes, so that during assembly the camshafts can be inserted into the lower half 440, and then subsequently the upper half 442 can be mounted. The upper and the lower halves 442, 440 are screwed together and/or to the cylinder head with screws 448, 449. In the present instance, the screws 448, 449 are arranged in pairs so as to lie opposite each other along the camshafts. The upper half 442 is designed like a hood so as to be closed in the area of the camshafts 426, 427, whereas the area between the camshafts 426, 427 is open at the top. In the area of the inlet sided cams there are bracket-like connections in the direction of the camshaft drive-sided area of the upper half 442. The lower half 440 includes laterally cylinder-shaped receptacles 444, 446. Into these receptacles are slid the cam follower shafts 422, 424 and secured there by use of axial retaining rings 423, 425. The valve control carrier 400 is made as an aluminum pressure die casting and subsequently machined. Therefore, the cylinder head and the control gear can then be machined and mounted separately and then assembled, a feature that offers significant advantages with respect to the production, assembly and/or maintenance.

With the internal combustion engine of the invention, it is possible to achieve high rotational speeds with simultaneously high valve acceleration. Moreover, the internal combustion engine can be manufactured at a low cost especially due to the small number of components. Since, in the present case, the flow traverses the cylinder head 100, 200, 300 in the longitudinal direction of the vehicle from the rear of the vehicle to the front of the vehicle, the flow into the outlet side is a function of the air stream, so that air cooling of the internal combustion engine is possible. In addition, this configuration offers advantages in terms of design because the exhaust manifolds can be aimed towards the front, and the fuel injection or carburetor can be arranged so as to be aimed in the direction of the rear of the vehicle. The small projection surface in the direction of travel induces a very good flow resistance value. A vehicle with such an internal combustion engine in boxer configuration allows an especially ergonomic driver posture.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An internal combustion engine, comprising:

a crankshaft;

at least one cylinder head having an inlet duct and an outlet duct, the cylinder head being traversed by flow in a direction from an inlet duct entrance on a first side of the cylinder head, the first side being in a plane transverse to the crankshaft to an outlet duct exit on a second side of the cylinder head which is opposite the first side, the second side being in a plane transverse to the crankshaft;

valves operatively configured for opening and closing the inlet and outlet ducts;

first and second camshafts for actuating the valves; and wherein two of the valves are inlet valves positioned together on the first side of the cylinder head and two of the valves are outlet valves positioned together on the second side of the cylinder head, both the first and the second camshaft are assigned one of the inlet valves and one of the outlet valves, the first and second camshafts being arranged parallel to the crankshaft.

2. The internal combustion engine according to claim 1, further comprising cam followers operatively configured for direct actuation of the valves.

3. The internal combustion engine according to claim 2, wherein the first camshaft and the second camshaft, and the cam followers including cam follower shafts, are operatively arranged in a structurally separate carrier.

4. The internal combustion engine according to claim 1, further comprising bucket tappets operatively configured for direct actuation of the valves.

5. The internal combustion engine according to claim 4, wherein the first camshaft and the second camshaft, and the bucket tappets, are operatively arranged in a structurally separate carrier.

6. The internal combustion engine according to claim 1, wherein the inlet and outlet valve slope outward toward their cam-sided ends in relation to a central plane.

7. A motor vehicle, comprising:

an internal combustion engine including:

a crankshaft;

at least one cylinder head having an inlet duct and an outlet duct, the cylinder head being traversed by flow in a direction from an inlet duct entrance on a first side of the cylinder head, the first side being in a plane transverse to the crankshaft to an outlet duct exit on a second side of the cylinder head which is opposite the first side, the second side being in a plane transverse to the crankshaft;

valves operatively configured for opening and closing the inlet and outlet ducts;

first and second camshafts for actuating the valves; and wherein both the first and the second camshaft are assigned an inlet valve and an outlet valve, the first and second camshafts being arranged parallel to the crankshaft.

8. The motor vehicle according to claim 7, wherein the motor vehicle is a motorcycle.

* * * * *